US006379629B1

(12) United States Patent
Kanai

(10) Patent No.: US 6,379,629 B1
(45) **Date of Patent: *Apr. 30, 2002**

(54) CARBONIZING APPARATUS HAVING A SPIRAL, ROTARY VANE

(76) Inventor: Masao Kanai, 18-10, Nagatasannoudai, Minami-ku, Yokohama (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/996,214

(22) Filed: Dec. 22, 1997

(30) Foreign Application Priority Data

Dec. 20, 1996 (JP) ..... 8-355111

(51) Int. Cl.[7] ..... F23C 9/00

(52) U.S. Cl. ..... 422/204; 422/189; 422/198; 422/202; 422/205; 422/225; 201/13; 202/127

(58) Field of Search ..... 422/204, 184.1, 422/205, 183, 182, 189, 198, 202, 224–225; 110/204, 203, 227, 345, 346; 202/111, 122, 123, 110, 151, 127; 201/13, 14, 15, 27, 35, 36, 37

(56) References Cited

U.S. PATENT DOCUMENTS 3,554,143 A * 1/1971 Rodgers et al. ..... 110/239
4,255,129 A * 3/1981 Reed et al. ..... 432/13
4,308,103 A * 12/1981 Rotter ..... 202/117
5,074,057 A * 12/1991 Kanai ..... 34/179
5,337,684 A * 8/1994 Summers ..... 110/346
6,471,937 * 12/1995 Kosky et al. ..... 110/345
5,586,396 A * 12/1996 Kanai ..... 34/59
5,655,465 A * 8/1997 Robertson ..... 110/346

FOREIGN PATENT DOCUMENTS

WO 94/15150 * 7/1994

* cited by examiner

*Primary Examiner*—Hien Tran
(74) *Attorney, Agent, or Firm*—Pillsbury Winthrop LLP

(57) ABSTRACT

A carbonizing apparatus permits effective use of an organic gas generated in a carbonizing vessel by utilizing an exhaust gas obtained by defusing the organic gas from the carbonizing vessel, as a heating source of the carbonizing vessel. The carbonizing apparatus has a carbonizing vessel having a carbonizing vessel jacket, into which a heating medium flows, a heat transmission surface forming an inner peripheral wall of the carbonizing vessel to be heated by the heating medium, a carbonizing object flowing means for flowing a carbonizing object charged thereinto, in contact with the heat transmission surface and a combustion furnace for burning an organic gas to be generated within the carbonizing vessel for defusing. The heating medium heating the heating surface is an exhaust gas as a heating gas after burning the organic gas in the combustion furnace, and the exhaust gas flowing into the carbonizing vessel jacket and discharging into an ambient air.

12 Claims, 5 Drawing Sheets

CARBONIZING APPARATUS HAVING A SPIRAL, ROTARY VANE

BACKGROUND OF THE INVENTION

1. Field of the Invention

The present invention relates generally to a carbonizing apparatus. More specifically, the invention relates to a carbonizing apparatus for defusing an organic gas to be generated during carbonizing process and to be effectively used in carbonizing process.

2. Description of the Related Art

As is well known, for wastes or so forth which generates harmful oxidized compounds through burning process, heating process under oxygen-free condition or lean oxygen condition, i.e. carbonizing process, has been performed. Considering the carbonizing apparatus to be employed in the carbonizing process, the apparatus includes only carbonizing vessel which has an inner wall surface serving as a heat transmission surface, and in which the waste and the like to be subject treatment, is charged. However, with such carbonizing vessel, since a harmful organic gas generated in the carbonizing vessel is discharged into the atmospheric air without being subject defusing process to be a cause of pollution. Therefore, in the prior art, as means for preventing such harmful organic gas from being discharge into the ambient air, a combustion furnace for defusing the organic gas is provided.

The carbonizing apparatus including the carbonizing vessel and the combustion furnace for defusing the organic gas encounters the following drawbacks. Namely, the combustion furnace for defusing the organic gas generated in the carbonizing vessel discharges an exhaust gas into the ambient air after defusing the organic gas. Therefore, the exhaust gas defused by defusing process cannot be utilized effectively. Also, in the carbonizing vessel, a separate heating source is required.

SUMMARY OF THE INVENTION

Therefore, it is an object of the present invention to provide a technology which permits effective use of an organic gas generated in a carbonizing vessel by utilizing an exhaust gas obtained by defusing the organic gas from the carbonizing vessel, as a heating source of the carbonizing vessel.

According to one aspect of the present invention, a carbonizing apparatus comprises:

a carbonizing vessel having a carbonizing vessel jacket, into which a heating medium flows, a heat transmission surface forming an inner peripheral wall of the carbonizing vessel to be heated by the heating medium, a carbonizing object flowing means for flowing a carbonizing object charged thereinto, in contact with the heat transmission surface; and a combustion furnace for burning an organic gas to be generated within the carbonizing vessel for defusing;

the heating medium heating the heating surface being an exhaust gas as a heating gas after burning the organic gas in the combustion furnace, and the exhaust gas flowing into the carbonizing vessel jacket and discharging into an ambient air. Preferably, the carbonizing object flowing means comprises a rotary vane rotatably arranged within the rotary vane, the rotary vane 8 having a plurality of vane blades, each vane blade being shaped for extending in obliquely upward in a direction opposite to a rotating direction of the rotary vane to elevate the carbonizing object along the vane blades, and being depressed onto the heat transmission surface in thin film form by the centrifugal force associating with rotation of the rotary vane. In the alternative, the carbonizing object flowing means comprises a rotary vane rotatably arranged within the rotary vane, the rotary vane 8 having a spiral vane blades, the spiral vane blade being shaped for extending in obliquely upward in a direction opposite to a rotating direction of the spiral rotary vane to elevate the carbonizing object along the vane blade, and being depressed onto the heat transmission surface in thin film form by the centrifugal force associating with rotation of the spiral rotary vane.

According to another aspect of the present invention, a carbonizing apparatus comprises:

a drying vessel having a drying vessel jacket, into which a heating medium flows, a heat transmission surface forming an inner peripheral wall of the drying vessel to be heated by the heating medium, a drying object flowing means for flowing a drying object charged thereinto, in contact with the heat transmission surface, and feeding a dried substance as a carbonizing object;

a carbonizing vessel receiving the carbonizing object, having a carbonizing vessel jacket, into which a heating medium flows, a heat transmission surface forming an inner peripheral wall of the carbonizing vessel to be heated by the heating medium, the carbonizing object flowing means for flowing a carbonizing object charged thereinto, in contact with the heat transmission surface; and a combustion furnace for burning an organic gas to be generated within the carbonizing vessel for defusing;

the heating medium heating the heat transmission surface of the carbonizing vessel being an exhaust gas as a heating gas after burning the organic gas in the combustion furnace, and the exhaust gas flowing into the carbonizing vessel jacket and discharging into an ambient air.

According to a further aspect of the present invention, a carbonizing apparatus comprises:

a drying vessel having a drying vessel jacket, into which a heating medium flows, a heat transmission surface forming an inner peripheral wall of the drying vessel to be heated by the heating medium, a drying object flowing means for flowing a drying object charged thereinto, in contact with the heat transmission surface, and feeding a dried substance as a carbonizing object;

a carbonizing vessel receiving the carbonizing object, having a carbonizing vessel jacket, into which a heating medium flows, a heat transmission surface forming an inner peripheral wall of the carbonizing vessel to be heated by the heating medium, the carbonizing object flowing means for flowing a carbonizing object charged thereinto, in contact with the heat transmission surface; and a combustion furnace for burning an organic gas to be generated within the carbonizing vessel for defusing;

the heating medium heating the heat transmission surfaces of the carbonizing vessel being an exhaust gas as a heating gas after burning the organic gas in the combustion furnace, and the exhaust gas flowing into the carbonizing vessel jacket and discharging into an ambient air.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscuring the present invention.

Figure 1:
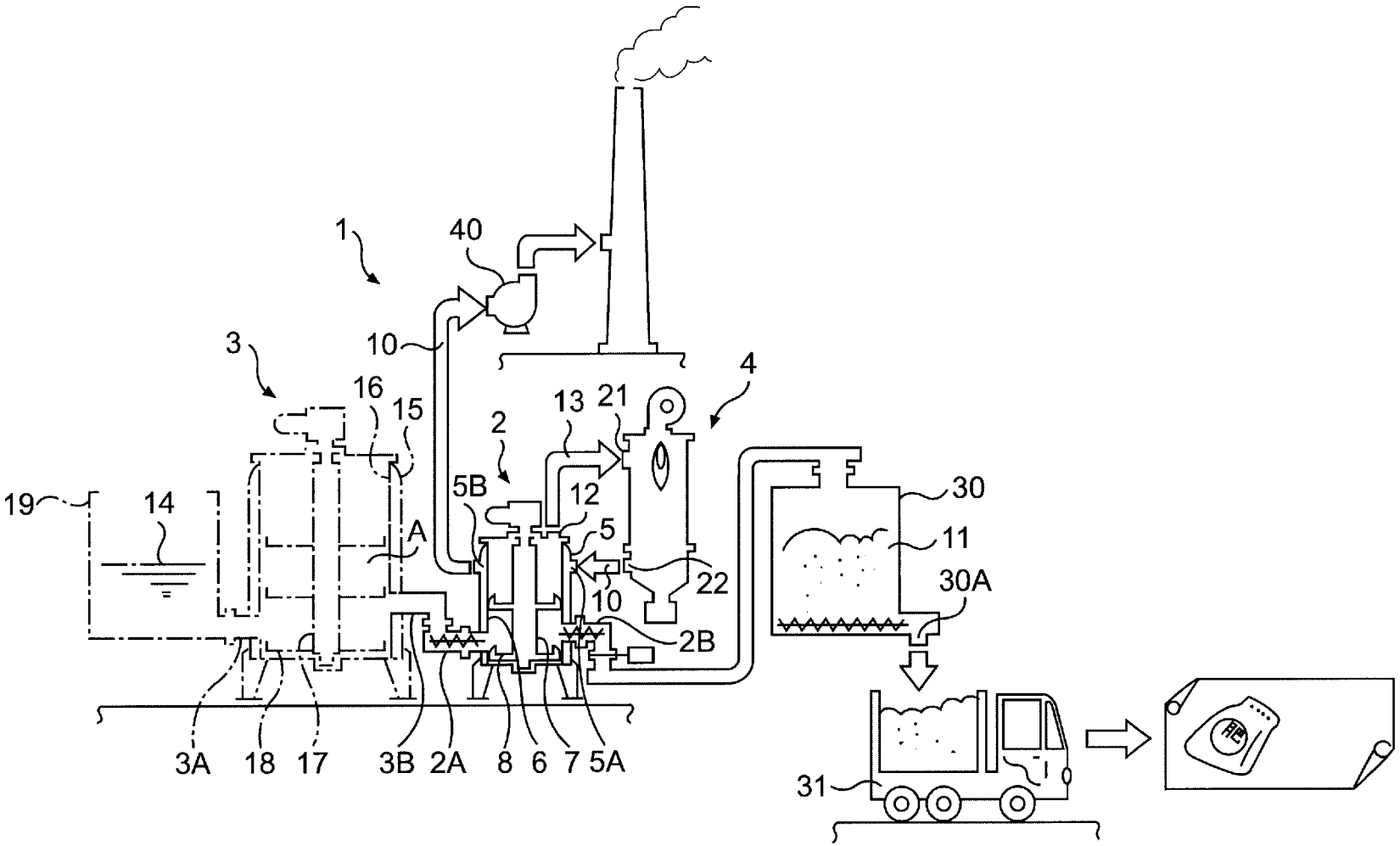
FIG. 1 is a general illustration showing an overall construction of the first embodiment of a carbonizing apparatus according to the present invention.
Figure 3:
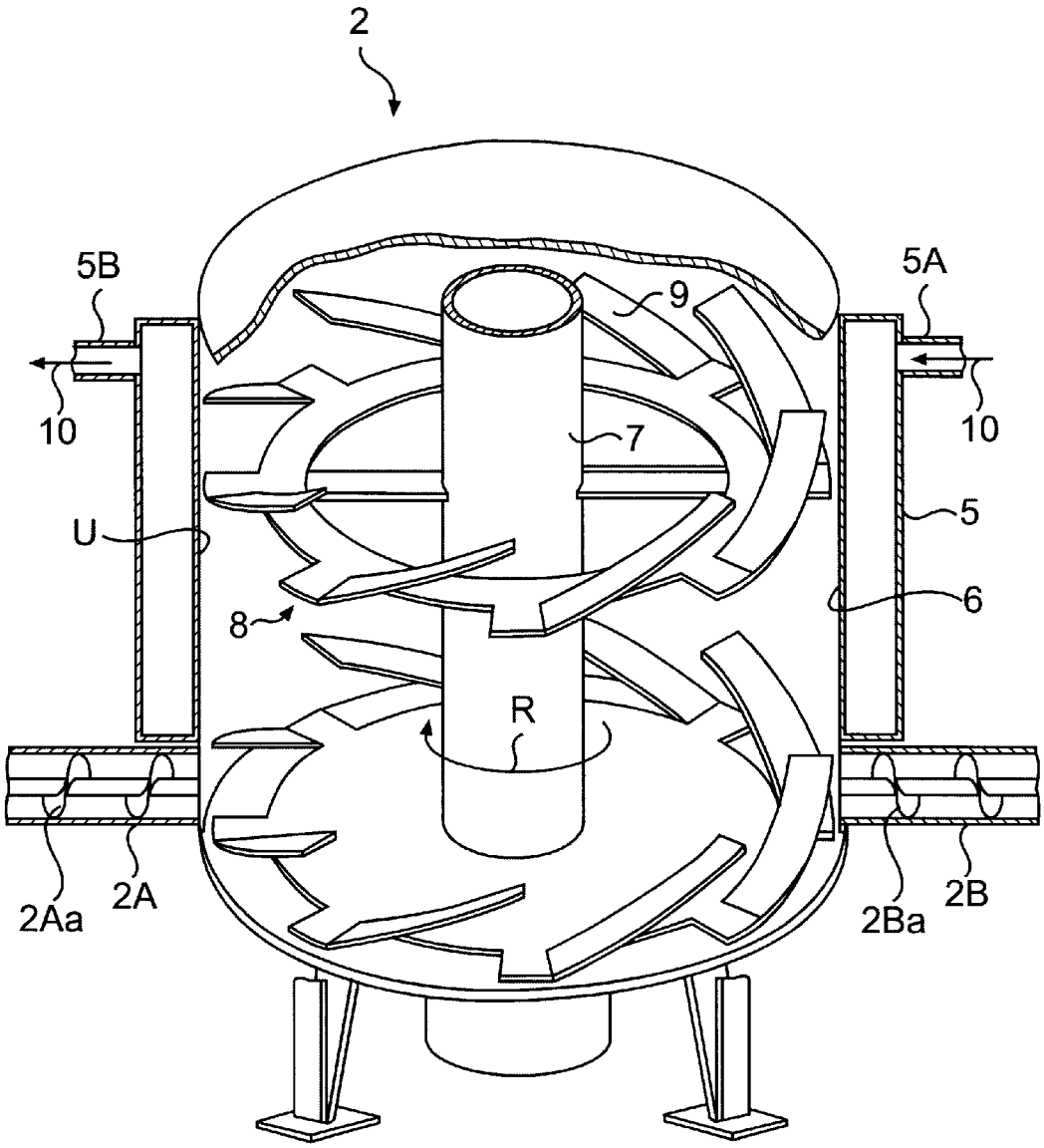
FIG. 3 is a perspective view showing a carbonizing vessel of the first embodiment of the carbonizing apparatus according to the present invention.
Figure 5:
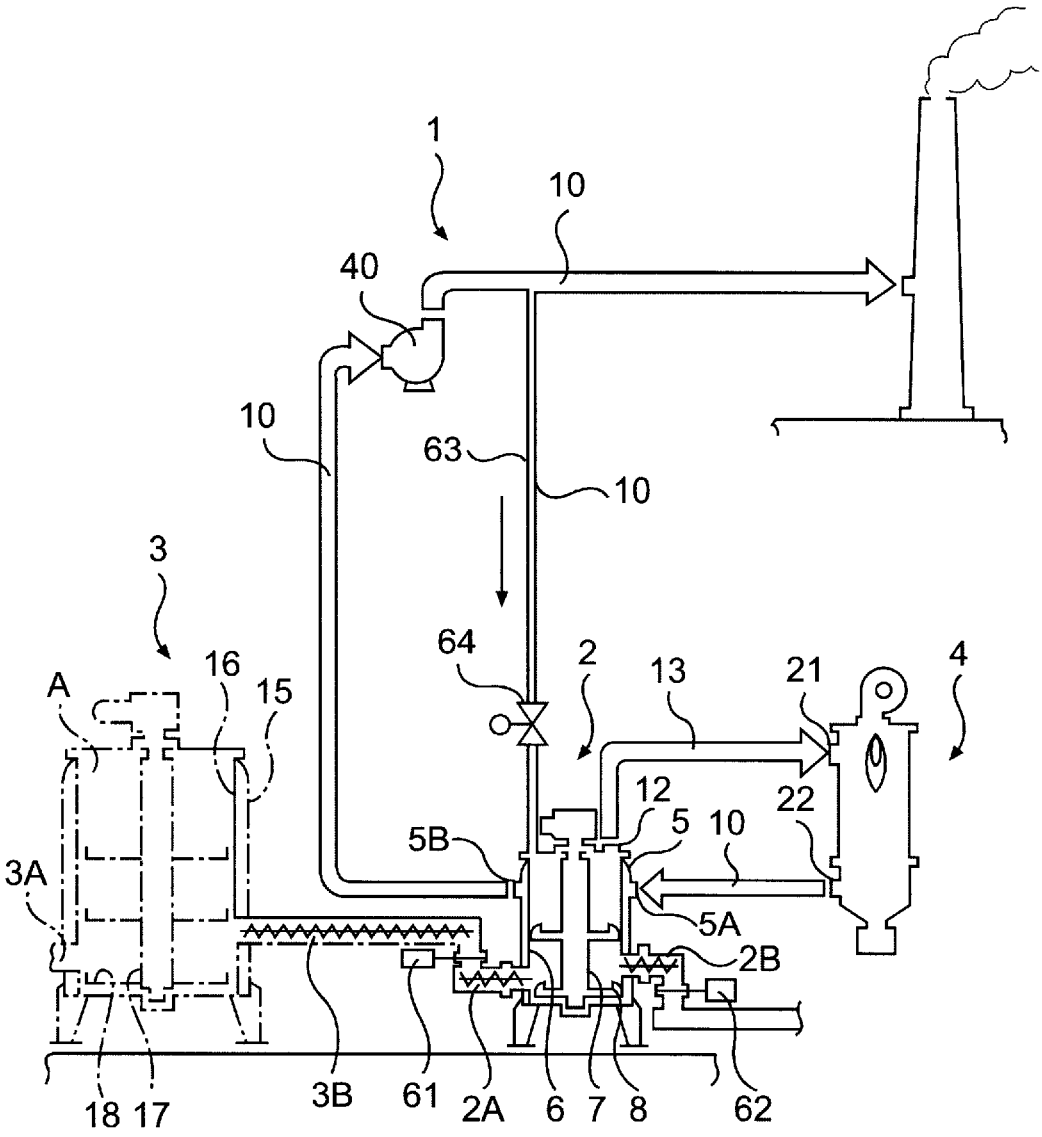
FIG. 5 is an illustration showing one example of a method for making inside of the carbonizing vessel into oxygen-free condition or lean oxygen condition.

The first embodiment of a carbonizing apparatus according to the present invention will be discussed hereinafter with reference to FIGS. 1 and 3. The carbonizing apparatus 1 includes a carbonizing vessel 2, a drying vessel 3 and a combustion furnace 4. The carbonizing vessel 2 is constructed into a cylindrical shape and is adapted to heat a carbonizing object under oxygen-free condition or lean oxygen condition to perform so called carbonizing process. On the outer periphery of the carbonizing vessel 2, a carbonizing vessel jacket 5 is arranged. The carbonizing vessel jacket 5 has an exhaust gas supply portion 5A, into which an exhaust gas 10 as a heating medium, is supplied, and an exhaust gas discharge portion 5B for discharging the exhaust gas 10 from the carbonizing vessel jacket 5. The exhaust gas discharging portion 5B is communicated with an exhaust gas blower 40 via a pipe passing the exhaust gas therethrough, in order to discharge the exhaust gas 10 into the ambient air. An inner wall surface of the carbonizing vessel 2 is heated by the exhaust gas 10 supplied into the carbonizing vessel 5. Thus, the inner wall surface serves as a heat transmission surface 6 of the carbonizing vessel 2. On the other hand, the carbonizing vessel 2 has an organic gas flow out portion 12 for guiding an organic gas 13 generated within the carbonizing vessel 2 into the combustion chamber 4. On the other hand, as a method for maintaining the interior of the carbonizing vessel 2 in oxygen-free condition or lean oxygen condition, after discharging the carbide and new carbonizing object is charged, shut-off valves 61 and 62 respectively provided at a carbonizing object supply portion 2A and a carbonizing object flow out portion 2B are closed, and a valve 64 of an exhaust gas supply pipe 63 is opened as shown in FIG. 5. An exhaust gas 10 containing a carbon dioxide gas is supplied within the carbonizing vessel 2 to replace any air within the carbonizing vessel 2 with the exhaust gas 10.

Within the carbonizing vessel 2, an carbonizing object flowing means forces the carbonizing object charged into the carbonizing vessel 2 to flow in contact with the heat transmission surface 6 of the carbonizing vessel 2. The carbonizing object flowing means, in the shown embodiment, comprises a rotary vane 8 for thrown or raising the carbonizing object within the carbonizing vessel. The rotary vane 8 is rigidly secured on a rotary shaft 7. The rotary shaft 7 extends through the interior space within the carbonizing vessel 2 in a direction of gravity and is rotatably supported therein. In the shown embodiment, two rotary vanes 8 are mounted on the rotary shaft 7 in an axially and thus vertically spaced relationship. Each of the rotary vanes 8 has a plurality of vane blades 9. Respective vane blades 9 are formed into identical shape with respect to each other. Respective vane blades 9 having outer edges displaced from the heat transmission surface 6 by a predetermined clearance U. As can be best seen in FIG. 3, each vane blade 9 extends in a direction opposite to the rotating direction of the rotary vane 8 and is upwardly inclined toward the rear tip end. The predetermined clearance is determined in such a manner that the carbonizing object may not fall down therethrough and can be thrown or raised by the vane blades 9 effectively as set out later.

On the other hand, the carbonizing vessel 2 has the carbonizing object supply portion 2A for supplying the carbonizing object into the carbonizing vessel 2 and the carbonizing object flow out portion 2B for guiding the carbide 11 resulting from carbonization of the carbonizing object. To the carbonizing object supply portion 2A and the carbonizing object flow out portion 2B, screws 2Aa and 2Ba conveying the carbonizing object and carbide 11 are mounted rotatably. The carbonizing object flow out portion 2B is communicated with a carbide hopper 30 through a connection pipe. The carbide 11 in the carbonizing vessel 2 is fed into the carbide hopper 30. The carbide hopper 30 has a carbide supply portion 30A. The carbide 11 accumulated in the carbide hopper 30 is transported by a transport vehicle.

Next, a drying vessel 3 is formed into a cylindrical shape. A drying vessel jacket 15 is provided on the outer periphery of the drying vessel 3. Within the drying vessel jacket 15, a vapor as a heating medium is supplied from a boiler (not shown). Then, the inner wall surface of the drying vessel 3 is heated by the vapor supplied to the drying vessel jacket 15. The inner wall surface serves as a heat transmission surface 16 of the drying vessel.

On the other hand, within the drying vessel 3, a rotary shaft 17 extending in a direction of gravity is rotatably mounted. On the rotary shaft 17, three rotary vanes 18 are rigidly secured in axially spaced apart relationship with respect to each other. Each of the rotary vanes 18 is formed with a plurality of vane blades.

The drying vessel 3 has a drying object supply portion 3A for supplying a drying object 14 within the drying vessel 3, and a dried substance flow out portion 3B for guiding the substance generated by drying the drying object 14 in the drying vessel 3. The drying object supply portion 3A is communicated with a drying object supply hopper 19 accumulating the drying object 14 via a connection pipe, and to a carbonizing object supply portion 2A of the carbonizing vessel 2 via the connection pipe. Namely, the dried substance generated in the drying vessel 3 is supplied to the carbonizing vessel 2.

The combustion furnace 4 is a furnace for completely burning the organic gas 13 generated in the carbonizing vessel 2 by direct combustion. The organic gas 13 flowing into the combustion furnace 4 from the carbonizing vessel 2 is burnt by a flame with oil 23 or the like as a fuel. The combustion furnace 4 has an organic gas supply portion 21 and an exhaust gas flow out portion 22. The organic gas supply portion 21 is communicated with the organic gas flow out portion 12 of the carbonizing vessel 2 via a connection pipe, and the exhaust gas flow out portion 22 is communicated with the exhaust gas supply portion 5A of the carbonizing vessel 2. Namely, the organic gas 13 in the carbonizing vessel 2 is introduced into the combustion furnace 4 and burnt therein. The exhaust gas 10 generated by combustion is introduced into the carbonizing vessel jacket 5 of the carbonizing vessel 2 as a heating gas to be a heating source of the carbonizing vessel 2.

With the construction set forth above, the first embodiment of the carbonizing apparatus generates the carbide through the following process which will be discussed hereinafter with reference to FIG. 1. At first, the drying object 14 is charged into the drying object supply hopper 19. Then, the drying object in the drying object supply hopper 19 is supplied into the drying vessel 3. The rotary vane 18 within the drying vessel 3 is driven to rotate. In conjunction therewith, the vapor is supplied into the drying vessel jacket 15 to heat the heat transmission surface 16. The drying object 14 supplied into the drying vessel 3 rides on the vane blades by rotation of the rotary vane 18 to be elevated along the vane blades. As a result, the drying object 14 is thrown or raised upwardly, and depressed onto the heat transmission surface 16 in a form of thin film by centrifugal force associating with rotation of the rotary vane 18.

The drying object depressed onto the heat transmission surface 16 of the drying vessel in thin film form has a surface contacting with the heat transmission surface 16 on one side. The drying object in the thin film form also has an evaporating surface to be contacted with the air in the interior space A of the drying vessel 3. The drying object 14 contacting with the heat transmission surface 16 causes evaporation of moisture content to a certain extent by the heat transmitted from the heat transmission surface 16 at the portion contacting with the heat transmission surface. By evaporation of the moisture content upon contacting with the heat transmission surface 16, the drying object 14 being lowered the moisture content is counterchanged with the drying object 14 having higher moisture content to move toward the evaporating surface. The drying object 14 thus moved to the evaporating surface is subject to the air in the interior space A to cause further evaporation of moisture.

The drying object 14 is thus moved to the evaporating surface from the heat transmission surface 16 and, in conjunction therewith, thrown or raised continuously by the rotary vane 18 of the drying vessel so that the former raised drying object 14 may push up the later raised drying object to continuously elevate along the heat transmission surface 16. Namely, the drying object 14 is continuously elevated along the heat transmission surface 16 with shifting from the heat transmission surface 16 to the evaporating surface. Then, the drying object 14 contacts with the heat transmission surface 16 of the drying vessel 3 at a contacting peripheral speed of about 50 to 60 m/s. Therefore, relatively large amount of the drying object 14 may contact with the heat transmission surface 16 per unit period to achieve high driving efficiency.

Thus, the dried substance is produced in the drying vessel 3. Next, the dried substance produced in the drying vessel 3 is supplied to the carbonizing vessel 2 as the carbonizing object. The rotary vane 8 in the carbonizing vessel 2 is in rotation as indicated by arrow R in FIG. 3. In conjunction therewith, the exhaust gas serving as heating gas is supplied from the combustion furnace 4 so that the heat transmission surface 6 of the carbonizing vessel 2 is heated. The carbonizing object supplied in the carbonizing vessel 2 rides on the vane blades 9 of the rotary vane 8 as rotated in the direction R to be elevated along respective vane blades 9. As a result, the carbonizing object is thrown or raised upwardly. In conjunction therewith, associating with centrifugal force by rotation or direction R of the rotary vane 8, the carbonizing object is depressed onto the heat transmission surface 6 of the carbonizing vessel at a predetermined contacting peripheral speed to form thin film to be depressed onto the heat transmission surface.

The carbonizing object depressed on the heat transmission surface 6 of the carbonizing vessel 2 in thin film form is carbonized by the heat from the heat transmission surface 6. At the same time, by throwing or raising by means of the rotary vane 8, the carbonizing object continuously raised on the vane blade 9 to be pushed upwardly in such a manner that the former raised carbonizing object is pushed by the later raised carbonizing object. Thus, the carbonizing object is continuously raised along the heat transmission surface 6 for efficiently being carbonized.

In the carbonizing vessel 2, the organic gas 13 separated from the solid component is generated during the carbonizing process of the carbonizing object. The organic gas 13 is introduced into the combustion furnace 4. The organic gas 13 introduced into the combustion furnace 4 is introduced into the carbonizing jacket 5 as the exhaust gas 10 of heating gas (at about 400 to 900° C.) after combustion under high temperature. Namely, the exhaust gas 10 is introduced from the combustion furnace 4 into the carbonizing vessel jacket 5. Thus, the heat transmission surface 6 of the carbonizing vessel is heated. Then, the carbonizing object contacts with the heat transmission surface 6 of the carbonizing vessel at the contacting peripheral speed at about 50 to 60 m/s. Therefore, an increased amount of carbonizing object may contact with the heat transmission surface 6 of the carbonizing vessel per unit period. Thus, the carbonizing object may easily reach a temperature of about 300 to 700° C. causing carbonizing of the carbonizing object. As a result, carbonization of the carbonizing object is progressed (carbonized in about 20 to 30 minutes) to achieve high efficiency. Then, as a whole of the carbonizing apparatus 1, the completely carbide can be produced in relatively short period (about 40 to 50 minutes) from initially charging the drying object. It should be noted that, in the combustion furnace 4, the organic gas 13 is defused by direct combustion into the exhaust gas 10. In conjunction therewith, removal of odor can be performed. On the other hand, since the organic gas 13 has relatively high calorie, fuel to be consumed in the combustion furnace 4 can be held small. Therefore, the combustion furnace 4 can be a fuel-efficient combustion furnace.

Next, after carbonization of the carbonizing object in the carbonizing vessel 2, the carbide thus produced is introduced into the carbide hopper 30. The carbide 11 in the carbide hopper 30 is transported by the transport vehicle 31 or so forth and is effectively used as fertilizer or the like. Also, the exhaust gas 10 in the carbonizing vessel jacket 5 is drawn by the exhaust gas blower 40 to be discharged to the atmosphere.

Figure 4:
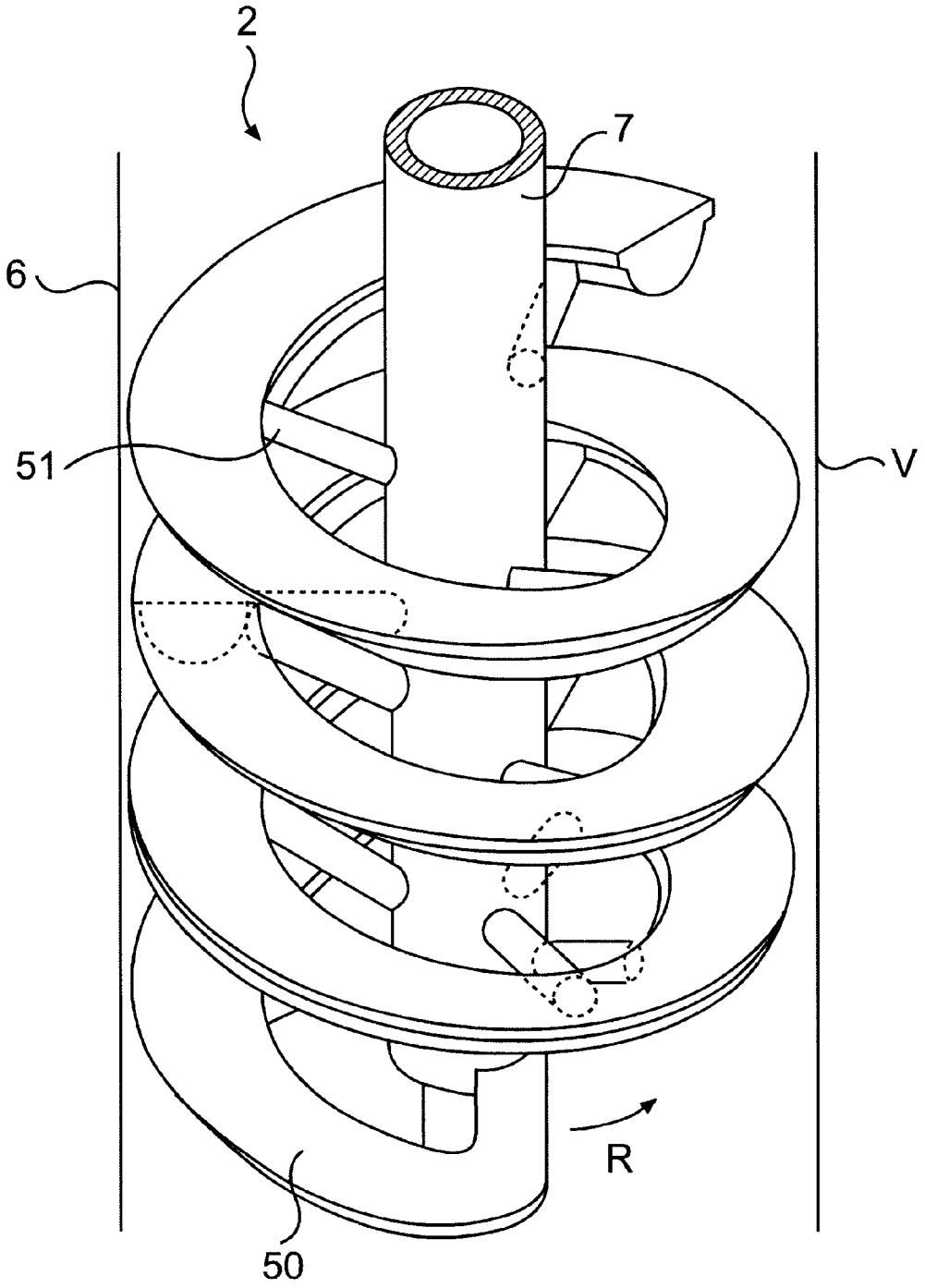
FIG. 4 is a perspective view showing another construction of a carbonizing vessel of the first embodiment of the carbonizing apparatus according to the present invention.

Next, another embodiment of the carbonizing vessel 2 will be discussed with reference to FIG. 4. In the first embodiment, the rotary vane 8 is employed as the carbonizing objecting flowing means for flowing the carbonizing object in contact with the heat transmission surface 6 within the carbonizing vessel 2. In contrast to this, a spiral rotary vane 50 is employed in place of the rotary vane 8 for raising the carbonizing object. The spiral rotary vane 50 is mounted on the rotary shaft 7 of the carbonizing vessel in spiral fashion by a plurality of stationary arms 51, and has a flat upper surface. On the other hand, the outer circumferential edge of the spiral rotary vane 50 is located in close proximity with the heat transmission surface 6 with a clearance V. The clearance V is selected so that the carbonizing object may not fall down therethrough while the spiral rotary vane 50 being in rotation in the direction of the arrow, and can be depressed onto the heat transmission surface 6. When the spiral rotary vane 50 is rotated in the direction of arrow R, the carbonizing object in the carbonizing vessel 2 climbs up sequentially along the spiral rotary vane 50 in a direction opposite to the rotating direction R of the spiral rotary vane 50. Furthermore, the carbonizing object is depressed onto the heat transmission surface 6 in thin film form with a predetermined peripheral speed by centrifugal force associating with rotation of the spiral rotary vane 50 in the rotating direction R.

The carbonizing object depressed onto the heat transmission surface in thin film form is progressively carbonized by the heat from the heat transmission surface 6. Then, the carbonizing object continuously climbs along the spiral rotary vane 50 to efficiently progress carbonization. When the carbonizing object reaches the uppermost position of the spiral rotary vane 50 to fall down to the bottom of the carbonizing vessel 2 to again climb upwardly. Namely, the carbonizing object can be carbonized by repeating circulating up and down.

It should be noted that the spiral rotary vane 50 discussed with reference to FIG. 4 may be used as vane blade in place of the rotary vane 18 of the drying vessel 3.

Figure 2:
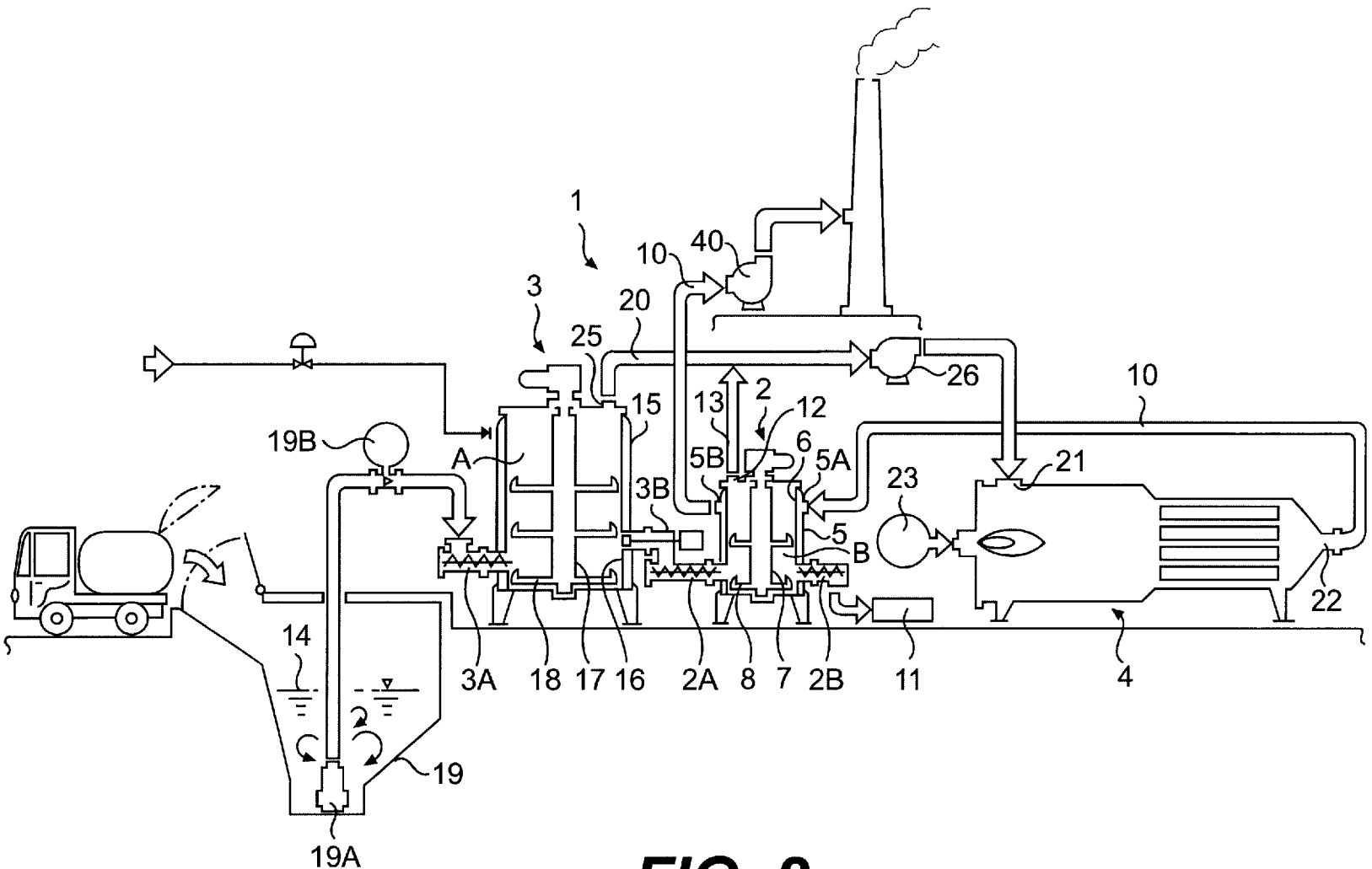
FIG. 2 is a general illustration showing an overall construction of the second embodiment of a carbonizing apparatus according to the present invention.

Next, the second embodiment of the carbonizing apparatus according to the present invention will be discussed with reference to FIG. 2. In the shown embodiment, the portions similar to those in the first embodiment will be neglected. Namely, in the first embodiment, only organic gas 13 generated in the carbonizing vessel 2 is introduced into the combustion furnace 4, and the exhaust gas 10 from the combustion furnace 4 is introduced into carbonizing vessel jacket 5. In the shown embodiment, in addition to the organic gas 13 in the carbonizing vessel 2, the organic gas 20 containing the vapor in the drying vessel 3 is introduced into the combustion furnace 4. The exhaust gas 10 from the combustion furnace 4 is introduced into the carbonizing vessel jacket 5. Therefore, the drying vessel 3 has the organic gas flow out portion 25 to communicate with the organic gas supply portion 21 of the combustion furnace 4 via the connection pipe. By this, the organic gas 20 in the drying vessel 3 is not discharged into the ambient air and can be effectively used as the heating source of the carbonizing vessel 2, defused in the combustion furnace by direct combustion, and in conjunction therewith, is discharged into the ambient air in defused condition. In FIG. 2, within the drying object supply hopper 19, a supplying and circulating pump 19A for supplying the fluidized drying object 14 in the drying vessel 3, is provided. In a connection pipe connecting the supplying and circulating pump 19A and the drying object supply portion 3A of the drying vessel 3, a flow meter 19B measuring an amount of the drying object 14 is provided. On the other hand, in the connection pipe connecting the carbonizing vessel 2 and the drying vessel 3 with the combustion furnace 4, an organic gas blower 26 introducing the organic gas 13 into the combustion furnace 4 is provided. The exhaust gas 10 from the combustion furnace 4 may be supplied not only to the carbonizing vessel 2 but also to the drying vessel 3.

As set forth above, according to the present invention, after defusing the organic gas in the carbonizing vessel by burning in the combustion furnace, and after combustion, by using the exhaust gas as the heating source of the carbonizing vessel, the organic gas can be effectively used as the heating source of the carbonizing vessel. Thus, it becomes unnecessary to separately provide the heating source for the carbonizing vessel to permit economical operation of the carbonizing vessel.

On the other hand, the carbonizing object is depressed onto the heating surface of the carbonizing vessel with the predetermined contacting peripheral speed by the rotary vane in thin film form. By this, the amount of the carbonizing object to be contacted with the heat transmission surface per unit period becomes large to reach the temperature high enough to cause carbonization of the carbonizing object at early timing. As a result, carbonization of the carbonizing object can be progressed quickly to improve carbonizing efficiency.

In the alternative, the carbonizing object is depressed onto the heating surface of the carbonizing vessel with the predetermined contacting peripheral speed by the spiral rotary vane in thin film form. By this, the amount of the carbonizing object to be contacted with the heat transmission surface per unit period becomes large to reach the temperature high enough to cause carbonization of the carbonizing object at early timing. As a result, carbonization of the carbonizing object can be progressed quickly to improve carbonizing efficiency.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A carbonizing apparatus comprising:

a combustion furnace that generates an exhaust gas by burning at least an organic gas;

a carbonizing vessel, having upper and lower portions, that carbonizes a carbonizable substance placed therein and that generates the organic gas during carbonization of the carbonizable substance;

a jacket disposed around the carbonizing vessel;

a vessel inlet through which the carbonizable substance is supplied to the carbonizing vessel;

a vessel outlet through which the carbonizable substance is discharged from the carbonizing vessel after being carbonized;

an organic gas outlet through which the organic gas is discharged from the carbonizing vessel and supplied to the combustion furnace;

an exhaust gas outlet through which the exhaust gas is discharged from the combustion furnace and supplied to the vessel jacket;

a jacket outlet through which the exhaust gas is discharged from the vessel jacket to ambient air;

a vessel heat transmission surface, internal to the vessel jacket, that is heated by the exhaust gas supplied to the vessel jacket;

a rotary shaft disposed within the carbonizing vessel in a direction parallel to the force of gravity;

a rotary vane mounted on the rotary shaft, the rotary vane having a plurality of vane blades extending obliquely upward in a direction opposite to a rotation direction of the rotary vane, the vane blades and the vessel heat transmission surface defining a clearance therebetween, so that, when the rotary vane is rotated, the carbonizable substance is carried upward along the vane blades while also, by centrifugal force, being pushed outward to the clearance between the vane blades and the heat transmission surface at a speed of about 50–60 m/s, the carbonizable substance being carbonized in a thin layer fashion on the heat transmission surface of the carbonizing vessel;

a drying vessel upstream of and in communication with the carbonizing vessel for receiving a substance to be dried and, once dried, for supplying the carbonizable substance to the carbonizing vessel, the carbonizing vessel's volume being smaller than the drying vessel's volume;

a drying vessel jacket around the drying vessel defining a drying vessel heat transmission surface in the drying vessel;

a drying vessel supply line for supplying the substance to be dried to the drying vessel;

a drying vessel discharge line in communication with the carbonizing vessel for discharging the carbonizable substance to the carbonizing vessel;

a boiler supplying heated vapor to the drying vessel jacket to heat the drying vessel heat transmission surface;

a throwing apparatus within the drying vessel that, in combination with the drying vessel heat transmission surface, dries the substance to be dried to reduce the volume of the substance to be dried and thereby create the carbonizable substance, wherein the drying vessel's throwing apparatus comprises a drying vessel rotary shaft disposed within the drying vessel, and a drying vessel rotary vane mounted on the drying vessel rotary shaft, the drying vessel rotary vane having a plurality of vane blades extending obliquely upward in a direction opposite to a rotation direction of the rotary vane, the drying vessel vane blades and the drying vessel heat transmission surface defining a clearance therebetween, so that, when rotated, the substance to be dried is carried upward along the drying vessel vane blades while also, by centrifugal force, being pushed outward to the clearance between the drying vessel vane blades and the drying vessel heat transmission surface at a speed of about 50–60 m/s, the substance to be dried being dried in a thin layer fashion on the drying vessel heat transmission surface;

a supply hopper upstream of and in communication with the drying vessel for supplying the substance to be dried to the drying vessel;

shut-off valves disposed in the vessel inlet and in the vessel outlet;

an exhaust gas supply line connected between the carbonizing vessel and the exhaust gas outlet for supplying at least some of the exhaust gas generated by the combustion furnace; and an exhaust gas valve disposed in the exhaust gas supply line;

wherein, when the shut-off valves are closed, air is prevented from entering the carbonizing vessel, and wherein, when the exhaust gas valve is opened, exhaust gas is supplied to the carbonizing vessel to replace any air within the carbonizing vessel to establish an oxygen-free or a lean oxygen atmosphere within the carbonizing vessel.

2. The carbonizing apparatus of claim 1, wherein:

the carbonizable substance carbonizes in about 20 to 30 minutes.

3. The carbonizing apparatus of claim 1, wherein:

the carbonizable substance reaches a temperature of about 300 to 700° C.

4. The carbonizing apparatus of claim 2, wherein:

the carbonizable substance reaches a temperature of about 300 to 700° C.

5. The carbonizing apparatus of claim 1, wherein:

the carbonizable substance becomes carbide in about 40 to 50 minutes.

6. The carbonizing apparatus of claim 5, wherein:

the carbonizable substance reaches a temperature of about 300 to 700° C.

7. The carbonizing apparatus of claim 2, wherein:

the carbonizable substance becomes carbide in about 40 to 50 minutes.

8. The carbonizing apparatus of claim 7, wherein:

the carbonizable substance reaches a temperature of about 300 to 700° C.

9. A carbonizing apparatus comprising:

a combustion furnace that generates an exhaust gas by burning at least an organic gas;

a carbonizing vessel that carbonizes a carbonizable substance placed therein and that generates the organic gas during carbonization of the carbonizable substance;

a jacket disposed around the carbonizing vessel;

a vessel inlet through which the carbonizable substance is supplied to the carbonizing vessel;

a vessel outlet through which the carbonizable substance is discharged from the carbonizing vessel after being carbonized;

an organic gas outlet through which the organic gas is discharged from the carbonizing vessel and supplied to the combustion furnace;

an exhaust gas outlet through which the exhaust gas is discharged from the combustion furnace and supplied to the vessel jacket;

a jacket outlet through which the exhaust gas is discharged from the vessel jacket to ambient air;

a vessel heat transmission surface, internal to the vessel jacket, that is heated by the exhaust gas supplied to the vessel jacket;

a drying vessel upstream of and in communication with the carbonizing vessel for receiving a substance to be dried and, once dried, for supplying the carbonizable substance to the carbonizing vessel;

a drying vessel jacket around the drying vessel defining a drying vessel heat transmission surface in the drying vessel;

a drying vessel supply line for supplying the substance to be dried to the drying vessel;

a drying vessel discharge line in communication with the carbonizing vessel for discharging the carbonizable substance to the carbonizing vessel;

a boiler supplying heated vapor to the drying vessel jacket to heat the drying vessel heat transmission surface;

a supply hopper upstream of and in communication with the drying vessel for supplying the substance to be dried to the drying vessel;

shut-off valves disposed in the vessel inlet and in the vessel outlet;

an exhaust gas supply line connected between the carbonizing vessel and the exhaust gas outlet for supplying at least some of the exhaust gas generated by the combustion furnace; and an exhaust gas valve disposed in the exhaust gas supply line;

wherein, when the shut-off valves are closed, air is prevented from entering the carbonizing vessel, wherein, when the exhaust gas valve is opened, exhaust gas is supplied to the carbonizing vessel to replace any air within the carbonizing vessel to establish an oxygen-free or a lean oxygen atmosphere within the carbonizing vessel, and wherein the carbonizable substance carbonizes in about 20 to 30 minutes.

10. The carbonizing apparatus of claim 9, wherein:

the carbonizable substance becomes carbide in about 40 to 50 minutes.

11. The carbonizing apparatus of claim 9, wherein:

the carbonizable substance reaches a temperature of about 300 to 700° C.

12. The carbonizing apparatus of claims 10, wherein: the carbonizable substance reaches a temperature of about 300 to 700° C.

* * * * *